United States Patent [19]

Paullin

[11] Patent Number: 4,608,573

[45] Date of Patent: Aug. 26, 1986

[54] FOCAL POINT POSITIONING TOOL

[76] Inventor: Dale Paullin, 1446 State Rte. 60, Ashland, Ohio 44805

[21] Appl. No.: 774,991

[22] Filed: Sep. 11, 1985

Related U.S. Application Data

[63] Continuation of Ser. No. 586,342, Mar. 5, 1984, abandoned.

[51] Int. Cl.[4] ..... H01Q 9/06

[52] U.S. Cl. ..... 343/894; 33/180 R

[58] Field of Search ..... 33/180 R; 343/760, 840, 343/894

[56] References Cited

U.S. PATENT DOCUMENTS

| | | | |
|---|---|---|---|
| 2,714,255 | 8/1955 | Glazer | 33/46 |
| 3,076,964 | 2/1963 | Reinhold | 343/761 |
| 3,164,835 | 1/1965 | Alsberg | 343/779 |
| 3,178,713 | 4/1965 | Yang | 343/840 |
| 3,832,717 | 8/1974 | Taggart | 343/840 |
| 3,983,562 | 9/1976 | Blanchard et al. | 343/840 |
| 4,126,865 | 11/1978 | Longhurst et al. | 343/766 |
| 4,201,991 | 5/1980 | Vines | 343/840 |

*Primary Examiner*—Eli Lieberman

*Attorney, Agent, or Firm*—Squire, Sanders & Dempsey

[57] ABSTRACT

A tool for indicating the position of a receiving device mounted on a convergent reflector with respect to the focus of that reflector, the tool having a collar and clamp for attaching it to the receiving device and converging, telescoping legs extending toward the reflector to indicate the angular and/or axial displacement of the receiving device from the focus of the reflector.

25 Claims, 8 Drawing Figures

FOCAL POINT POSITIONING TOOL

CROSS REFERENCE TO RELATED APPLICATION

This is a continuation of application Ser. No. 586,342, filed Mar. 5, 1984, now abandoned the benefit of whose filing date is hereby claimed.

BACKGROUND

The present invention relates to the rapid positioning of a receiving or transmitting device at the focal point of a convergent reflector.

High gain antennas for microwaves and higher frequency radiation use reflectors having a surface described by the rotation of a conic section having a focus. The usual figure described by a reflector surface is a parabola, but any reflector shape that has a focal point, a point where parallel incoming rays of energy converge, i.e. any convergent reflector, will provide a high gain. The highest quality performance is obtained from the antenna if the receiving or transmitting device is positioned at the focal point of the reflector. For microwaves, this receiving or transmitting device is usually a feedhorn. For a solar energy concentrator, the receiving device could be a thermopile or other thermal energy converter.

Recently high gain reflector antennas have become popular within consumers for receiving television signals relayed to earth by synchronous satellites. The antennas are typically assembled at the point of use. Locating the receiver feedhorn precisely at the focus of the antenna at the time of first installation and from time to time as maintenance is performed can be quite difficult. One positioning method involves use of an expensive signal strength meter monitored by one person who gives instructions to another who adjusts the position of the receiving device to maximize the signal strength. This method is too expensive for home use. Other methods involve straight sticks that are inserted in the reflector or receiving device in order to attempt to align the device and the center of the antenna. While these sticks are cheap, they are also inaccurate and unreliable.

SUMMARY OF THE INVENTION

In the invention, a simple, inexpensive positioning tool is disclosed that permits a receiving device to be accurately positioned at the focus of the receiver quickly by one person. The tool is attached to the receiving device and clamped into position on it. Because the tool is lightweight it does not produce any appreciable deflection of the support, which may be a waveguide or an inflexible coaxial cable In a preferred embodiment, three converging legs on the tool extend toward the reflector. These legs may be solid or hollow and are fitted with either a telescoping sleeve or telescoping rod, respectively. The sleeves or rods are extended to the reflector and may be clamped at a desired degree of extension. Preferably, the sleeves or rods bear fiduciary marks so that all may be extended the same length. By knowing the correct axial length of the reflector to the focal point and adjusting the legs of the tool accordingly, the tool will indicate whether the receiving device needs to be adjusted and, if so, in what direction from the reflector. When the receiver is precisely aligned with the axis of the reflector, the sleeves or rods will be symmetrically disposed about the center point of the reflector. In the preferred embodiment, the three indicated points show in what direction the receiving device must be moved in order to obtain the focal positioning desired. When that positioning is obtained, the desired symmetrical spacing is achieved. The open construction of the legs of the tool does not interfere with, nor is its use prevented by the waveguide or coaxial cable typically extending from the receiving device and passing through the center of the reflector.

A stabilizing support Joined to the legs intermediate of their length helps to maintain the accuracy of the tool. The tool is simple in construction and use, rugged and inexpensive.

DETAILED DESCRIPTION OF PREFERRED EMBODIMENTS

Figure 1:
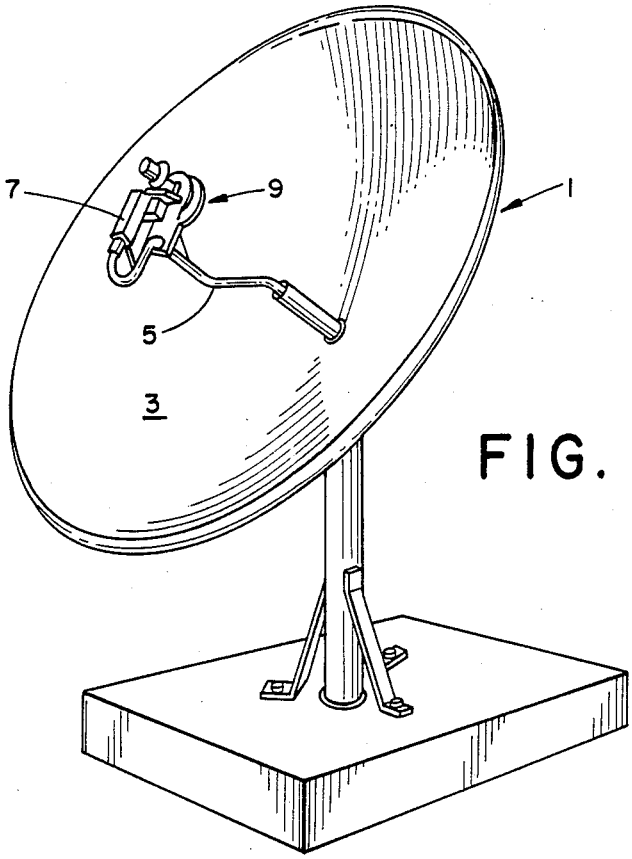
FIG. 1 is a perspective view of a satellite receiving antenna including a convergent reflector.
Figure 2:
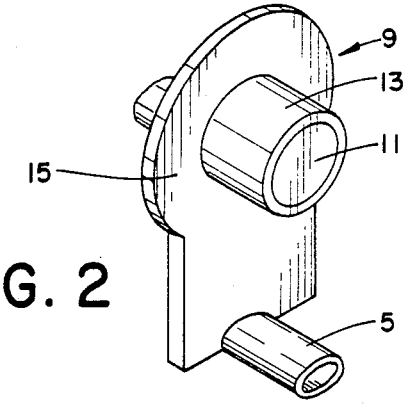
FIG. 2 is a detailed partial, frontal perspective view of a receiving device for a satellite receiving antenna employing a convergent reflector.

A typical satellite downlink receiver antenna 1 is shown in FIG. 1. The receiver includes a convergent reflector 3, typically a parabola. A radio frequency transmission line 5, which may be a waveguide or stiff coaxial cable passes through the center of reflector 3. The opposite end of transmission line is bent to support electronic equipment 7, such as a preamplifier to boost the strength of the received signals. A receiving device 9, such as a feedhorn or other appropriate antenna, is located at the end of the transmission line and pointed toward reflector 3 to gather the signal reflected from and focussed by reflector 3. Because of the bend in the transmission line, this assembly is referred to as a "button hook." A portion of a typical receiving device 9 is shown in FIG. 2. Typically, receiving device 9 has a receiving aperture 11 covered by a dielectric window within a circular hood 13 surrounded by a peripheral flange 15.

Figure 3:
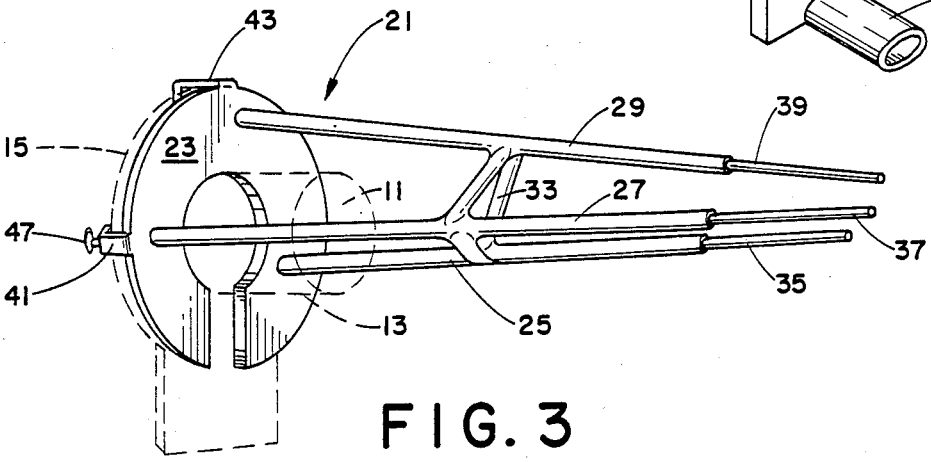
FIG. 3 is a frontal perspective view of a preferred embodiment of the inventive tool mounted on a receiving device partially shown in phantom lines.

In FIG. 3, a frontal perspective view of a preferred embodiment of the inventive positioning tool 21 for locating a receiving device at the focus of a convergent reflector is shown. Tool 21 is shown mounted on receiving device 9 which is partially shown in broken lines Tool 21 includes a collar 23 open at one side to slide over and peripherally engage hood 13 of receiving device 9 Three legs, 25, 27 and 29 are joined to collar 23, for example by welding. Legs 25, 27 and 29 are preferably equally spaced around collar 23; that is, radii drawn from the geometric center of collar 23 to each leg are spaced 120° from each other. Each of the legs forms the same acute angle 31 with collar 23, so that the legs converge in the direction of the convergent reflector when the tool is mounted on the receiving device. A stabilizing brace 33 disposed transversely to legs 25, 27 and 29 and attached to each of them steadies the legs and maintains the accuracy of the tool. The brace embodiment shown is preferably a welded rod or tube, but a solid plate may also be used. With a button hook type receiver and transmission line the brace need not be modified to accomodate the transmission line if the brace is placed near enough to the receiving device. Other constructions may require a cut-out in the brace to avoid interference between the tool and transmission line.

In the embodiment shown in FIG. 3, each of legs 25, 27 and 29 are tubular and each contains a rod that telescope within its respective leg. Legs 25, 27 and 29 receive rods 35, 37 and 39, respectively. The rods may be extended so their ends are near the surface of a reflector to indicate whether the receiving device is at the focus of the reflector as hereinafter described, or retracted into their respective legs for storage.

Figure 4:
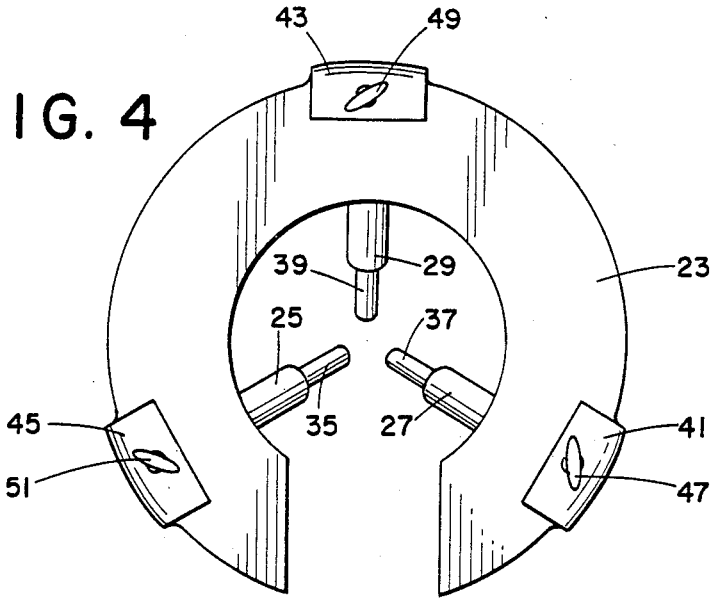
FIG. 4 is a rear view of a preferred embodiment of the inventive tool.

In addition to using the inside of collar 23 for attachment of the tool to the receiving device, in the preferred embodiment three c-clamps 41, 43 and 45 depend from the rear of collar 23. These clamps are visible in the rear view of FIG. 4 and two clamps can be partially seen in FIG. 3. Each clamp has a thumbscrew 47, 49 and 51 passing through a threaded hole in the clamp for clamping collar 23 to the receiving device, for example, to flange 15.

Figure 5:
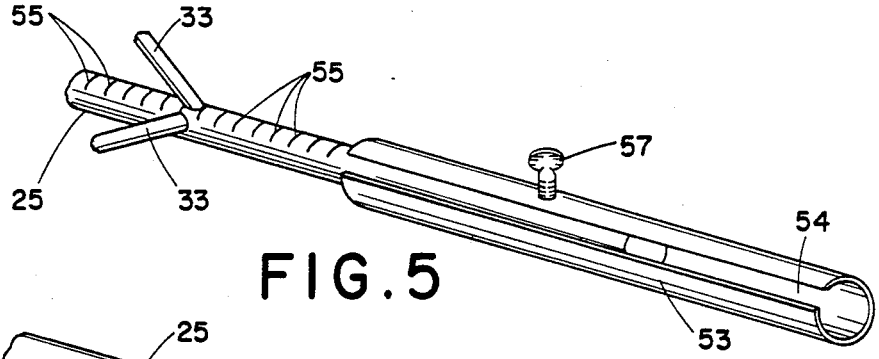
FIG. 5 is a partial, detail view of an alternative preferred construction of a portion of the inventive tool.

An alternative construction of the legs and rods is shown in the partial, detail view of FIG. 5. There, leg 25 is shown and may be tubular or solid. However, the indicating finger is not a rod telescoping within leg 25 as previously described, but a sleeve 53 telescoping over leg 25. The sleeve has a lengthwise split 54 in order to pass over bracket 33 readily. FIG. 5 also shows that leg 25 bears fiduciary marks 55 for setting its extension to a desired length. As discussed below, it is desirable to extend the indicating fingers the same length and the marks are important to achieving that end. In the alternative embodiment, the rods bear the fiduciary marks.

Figure 6:
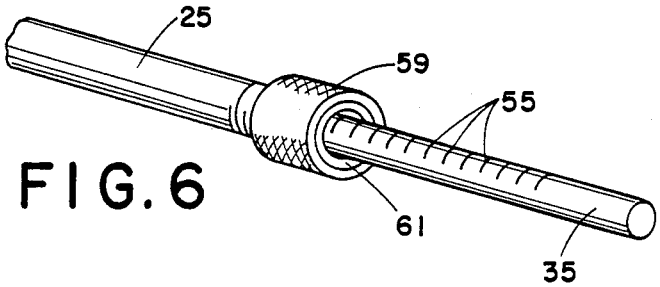
FIG. 6 is a partial detail view of an alternative preferred construction of a portion of the inventive tool.

It is also important to keep the extended fingers, whether rods or sleeves, at the desired length while the position of the receiving device is adjusted. FIG. 5 shows one embodiment of a retainer for the fingers. There, the retainer comprises a simple thumbscrew 57 engaging a threaded hole in sleeve 53. Tightening the screw to bear on leg 25 frictionally locks sleeve 53 in place. This embodiment also may be used when the finger is a rod, but there the screw engages a threaded hole in the leg 25 and bears on rod 35 to lock it by friction. Another retainer embodiment is shown in FIG. 6 for use with the rod type finger. There, a compression nut 59 engages a threaded end on leg 25. An elastic washer 61 within nut 59 is compressed as nut 59 is tightened and locks rod 35 in place by friction.

The use of the inventive tool is illustrated in FIG. 7. The tool is attached to the receiving device by slipping collar 23 over the receiving device and tightening the c-clamps. The fingers of the tool are then extended to near the surface of the reflector. Ordinarily, the distance to the reflector from the receiving device is set to the proper axial distance from the reflector to its focal point. However, this distance is often adjustable and can be set to the proper length by using the tool. The fingers of the tool are adjusted to provide the desired axial length and the receiving device is set at a distance greater then the focal length. Then the receiving device is moved toward the reflector until the fingers touch the reflector. The receiving device is then locked in axial position.

Figure 7A:
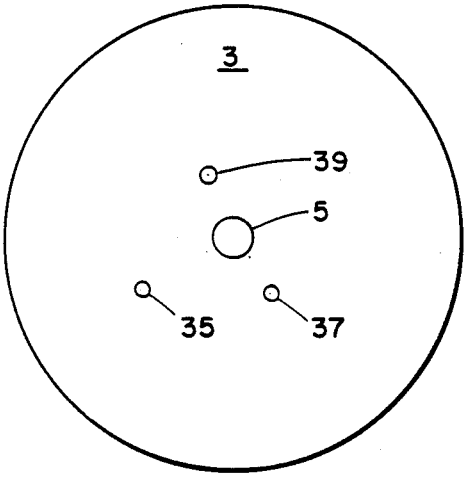
FIGS. 7A and 7B schematically illustrate the use of the inventive tool.
Figure 7B:
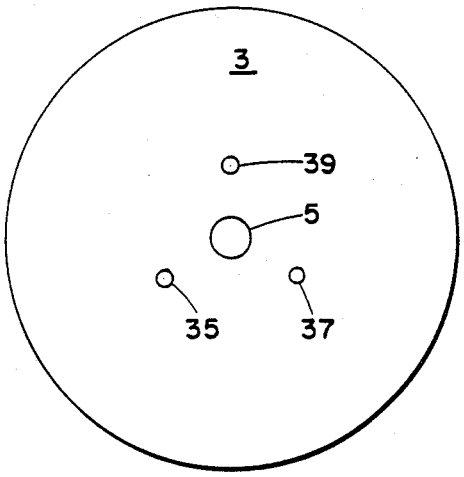

More often, the receiving device is set at the proper axial length, but is off the reflector axis. Again, the tool is attached to the receiving device and all the indicating fingers are extended the same length to touch or nearly touch the reflector. If the receiving device is off axis, the fingers will not be symmetrically disposed about the center of the reflector through which the transmission line passes. This circumstance is shown in FIG. 7A where reflector 3 is shown schematically with the points indicated on the reflector by fingers 35, 37 and 39. The misaiming is readily detected from the asymmetrical distribution of the fingers about transmission line 5. The aim of the receiving device is then adjusted to bring fingers 35, 37 and 39 into a symmetrical disposition about the transmission line as shown in FIG. 7B. Because the fingers converge to encompass a relatively small area at the reflector surface, small asymmetries are easily observed and corrected. Only one person is needed to aim the receiving device, simply, quickly and accurately with the tool. The tool is so inexpensive to make that a home user of a satellite receiver can readily afford to have one.

Various modifications of the tool are possible. While I prefer the three legged version to "triangulate" off axis errors, a two legged version that would alternately be used to correct each of two orthogonal axial misalignments could be built. The use of the tool is not restricted to receivers, but is readily applicable to transmitting antennas as well. In addition, it can be used to focus solar reflectors and other convergent reflectors for electromagnetic radiation outside the radio frequency spectrum.

The invention has been described with reference to certain preferred embodiments. Various additions and modifications within the spirit of the invention will occur to those of skill in the art. Accordingly the scope of the invention is limited solely by the following claims.

I claim:

1. A tool for indicating the position of a receiving device relative to the focus of a convergent reflector, said tool comprising:

attachment for attaching the tool to a receiving device mounted on a convergent reflector having a focus; and, an indicating means comprising at least two converging legs extending from said attachment means toward said reflector, and an extension means slidably disposed with respect to each of said legs for extension to said reflector to indicate the position of said receiving device with respect to said focus.

2. The invention of claim 1 further including a stabilizing brace disposed transversely to, and attached to, each of said legs.

3. The invention of claim 1 wherein said attachment means includes a collar for peripherally engaging said receiving device.

4. The invention of claim 1 wherein said attachment means includes clamping means for clamping the tool to said receiving device.

5. The invention of claim 4 wherein said attachment means includes a collar for peripherally engaging said receiving device and said clamping means includes at least one c-clamp depending from said collar for clamping said collar to said receiving device.

6. The invention of claim 1 wherein said extension means comprises a finger telescoping with a said leg.

7. The invention of claim 6 wherein said leg includes retaining means for selectively retaining said finger at any chosen extension from said leg.

8. The invention of claim 7 wherein said finger comprises a rod telescoping within said leg.

9. The invention of claim 8 wherein said retaining means comprises a compression nut and elastic washer threaded on said leg for frictionally engaging said rod.

10. The invention of claim 9 wherein said leg includes a threaded hole and said retaining means comprises a screw screwed into said threaded hole for frictionally engaging said rod.

11. The invention of claim 7 wherein said finger telescopes over said leg and has a threaded hole, said retaining means comprising a screw screwed into said threaded hole for frictionally engaging said rod.

12. The invention of claim 6 wherein said finger bears fiduciary marks for indicating its extension relative to said leg.

13. The invention of claim 1 having three legs and wherein said attachment means comprises a collar for peripherally engaging said receiving device and a clamping means for clamping said collar to said receiving device.

14. The invention of claim 13 further including a triangular stabilizing brace disposed transversely to, and attached to, each of said legs.

15. The invention of claim 13 wherein said extension means comprises three fingers, each of said fingers telescoping with one of said legs.

16. The invention of claim 15 wherein each leg includes retaining means for selectively retaining the finger telescoping with it at any chosen extension from said leg.

17. The invention of claim 15 wherein each of said fingers bears fiduciary marks for indicating its extension relative to the leg with which it telescopes.

18. The invention of claim 15 wherein each finger comprises a rod telescoping within one of said legs.

19. The invention of claim 15 wherein each finger telescopes over one of said legs.

20. A detachable tool for aiding in the adjustment of a receiving or transmitting device relative to the focus of a convergent reflector of an antenna, said tool comprising:

indicating means for indicating the position of said device with respect to said focus of said reflector, said indicating means comprising at least two legs positionable between said device and said reflector;

each of said legs having a proximate end connected to said connecting means and a free distal end which converges towards the free distal end of the other of said legs;

said indicating means further comprising a slidable element on each of said legs for extension of said indicating means toward said reflector; and, connecting means for attaching and detaching said legs to and form said device.

21. The tool of claim 20, wherein said indicating means further comprises fiduciary marks for indicating the degree of extension of each of said slidable elements with respect to its corresponding leg.

22. The tool of claim 21, further comprising a releasable retaining means for securing each said slidable element with its corresponding leg and for selectively allowing movement of said slidable element with respect to said leg.

23. A method for adjusting the position of a receiving or transmitting device relative to the focus of a convergent reflector on an antenna which has a known correct axial distance between said device and said focus, comprising the steps of:

providing a tool having an indicating means comprising at least two legs positionable between said device and said reflector, each of said legs having a proximate end connectable to said device and a free distal end which converges towards the free distal end of the other of said legs;

adjusting the length of each of said legs to correspond to said known correct axial distance;

attaching said tool to said device with each of said legs extending from said device toward said focus;

after said providing, adjusting and attaching steps, moving said device until the distance from said device to said focus is approximately the length of each of said legs; and, after said providing, adjusting, attaching and moving steps, positioning said device until the distance from said focus to the free distal end of each leg is approximately equal to the distance from said focus to the free distal end of each of the other legs.

24. The method of claim 23, wherein said indicating means comprises at least three legs.

25. The method of claim 23, wherein said indicating means comprises only two legs and said method further comprises the steps of:

after said providing, adjusting, attaching, moving and positioning steps, rotating said indicating means until the line then defined by said free distal ends of said legs is approximately orthogonal to the line previously defined at the end of said positioning step by said free dsital ends, and again positioning said device until the distance from said focus to each of said free distal ends is equalized.

* * * * *

UNITED STATES PATENT AND TRADEMARK OFFICE

CERTIFICATE OF CORRECTION

PATENT NO. : 4,608,573

DATED : August 26, 1986

INVENTOR(S) : Dale Paullin

It is certified that error appears in the above-identified patent and that said Letters Patent are hereby corrected as shown below:

In line 4 of claim 1 (line 46 of column 4), insert --means-- after "attachment" and before "for."

In the last line of claim 20 (line 7 of column 6), delete "form" and substitute --from--.

In line 9 of claim 25 (line 51 of column 6), delete "dsital" and substitute --distal--.

Signed and Sealed this

Thirteenth Day of January, 1987

*Attest:*

DONALD J. QUIGG

*Attesting Officer*

*Commissioner of Patents and Trademarks*